US006514070B2

(12) United States Patent
Lu

(10) Patent No.: US 6,514,070 B2
(45) Date of Patent: Feb. 4, 2003

(54) TORCH

(75) Inventor: James Lu, Roswell, GA (US)

(73) Assignee: International Business Corporation, Alpharetta, GA (US)

( * ) Notice: Subject to any disclaimer, the term of this patent is extended or adjusted under 35 U.S.C. 154(b) by 0 days.

(21) Appl. No.: 09/730,880

(22) Filed: Dec. 7, 2000

(65) Prior Publication Data

US 2001/0053504 A1 Dec. 20, 2001

Related U.S. Application Data

(63) Continuation-in-part of application No. 09/596,872, filed on Jun. 19, 2000.

(51) Int. Cl.[7] ..... F23Q 25/00

(52) U.S. Cl. ..... 431/152; 431/149; 431/324; 431/343; 431/33

(58) Field of Search ..... 431/33, 34, 152, 431/146, 144, 310, 320, 149, 324, 343, 344; 362/415, 431, 806

(56) References Cited

U.S. PATENT DOCUMENTS

| | | | | | |
|---|---|---|---|---|---|
| 1,134,314 | A | * | 4/1915 | Canchester | 431/146 |
| 3,066,515 | A | * | 12/1962 | Virtanen | 431/152 |
| 4,477,247 | A | * | 10/1984 | Kumasaka | 431/320 |
| 5,807,093 | A | * | 9/1998 | Tendick, Sr. | 431/320 |

FOREIGN PATENT DOCUMENTS

| | | | | | |
|---|---|---|---|---|---|
| FR | 2 764 968 | A | * | 12/1998 | |
| JP | 56-20930 | A | * | 2/1981 | 431/152 |

* cited by examiner

*Primary Examiner*—Henry Bennett
*Assistant Examiner*—Josiah Cocks
(74) *Attorney, Agent, or Firm*—Rodgers & Rodgers

(57) ABSTRACT

A torch comprising a frame structure with a fuel container disposed therein, a flame guard cap extending upwardly from the frame with an aperture formed therein, a wick disposed in the aperture, and a rotatable snuffer cap attached to the frame and adapted to cover the wick.

8 Claims, 2 Drawing Sheets

TORCH

This is a continuation-in-part of application Ser. No. 09/596,872 filed Jun. 19, 2000.

BACKGROUND OF THE INVENTION

Outdoor entertaining during the evening hours has become quite popular. One method of providing lighting while at the same time creating an atmosphere of conviviality is to utilize open flame torches.

Traditionally, torches have included the basic fuel container, wick and snuffer cap. Typically, the snuffer cap is attached to the fuel container or frame therefor by such means as a chain or wire. Of course, in order to extinguish the flame, this type of snuffer cap must be grasped by using tongs, a towel and the like. Since the flame and surrounding metal parts are quite hot, this means of extinguishing the flame is quite cumbersome and somewhat dangerous.

SUMMARY OF THE INVENTION

A torch comprising a frame with a fuel container disposed therein, a flame guard cap extending upwardly from the fuel container and having an aperture formed therein, a wick disposed in the aperture, a snuffer cap rotatably mounted on the frame and adapted to selectively cover the wick. Rotational movement of the snuffer cap is accomplished by means of a U-shaped clip which is pivoted to the frame at one end and snuffer cap lever means pivoted at the other end with the snuffer cap secured to one end of the lever means.

DESCRIPTION OF THE PREFERRED EMBODIMENT

Figure 1:
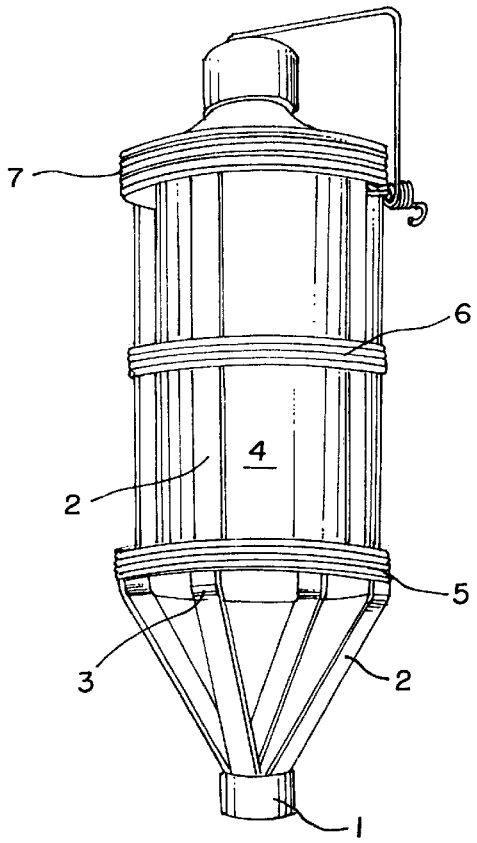
FIG. 1 is a perspective view of a torch according to this invention.

In the drawings and with particular attention to FIG. 1, the numeral 1 designates the torch base with multiple struts 2 extending upwardly therefrom to form a frame. Struts 2 are bent so as to provide edges 3 upon which fuel container 4 is positioned. Extending upwardly from edges 3, struts 2 are coextensive with fuel container 4. To complete the frame, multiple rims 5, 6 and 7 act to hold struts 2 in place. More specifically, lower rim 5, intermediate rim 6 and upper rim 7 are provided, the inner surfaces of which are attached to the outer surfaces of struts 2 by any suitable means such as welding.

Attached to the upper edge of upper rim 7 is flame guard 8 with aperture 9 formed therein. Wick 10 is positioned in aperture 9 and extends into fuel container 4 as is well known in the art. Of course, fuel container 4 is filled with ordinary lamp oil or any other suitable fuel.

According to this invention, snuffer cap 11 is provided and is attached to lever arm 12 which is bent at approximately its midpoint to form a 90 degree angle. Formed on the end of lever arm 12 opposite from snuffer cap 11 is helical element 13 and twist knob 14. Attachment bar 15 extends through helical element 13 with the free ends thereof attached to the associated strut 2.

Figure 2:
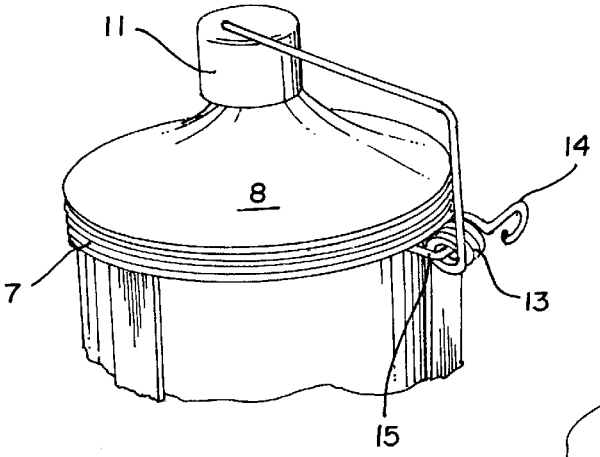
FIG. 2 is an enlarged perspective view of the upper portion of the torch with the snuffer cap in the closed position.
Figure 3:
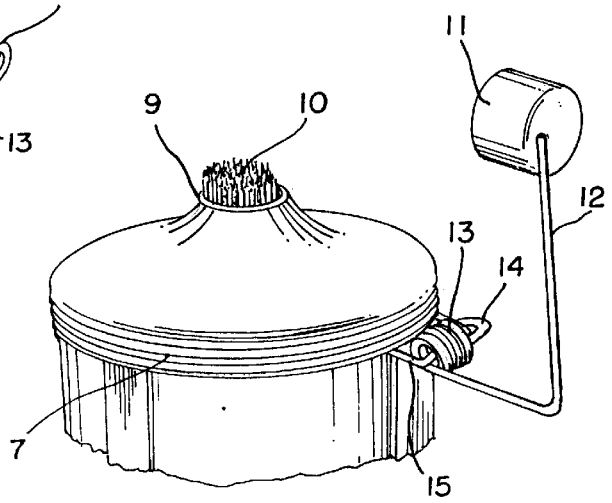
FIG. 3 is an enlarged perspective view of the upper portion of the torch with the snuffer cap in the open position.

In operation, with the torch as shown in FIG. 3, wick 10 is lighted in the normal fashion. When it is desired to extinguish the flame, twist knob 14 is simply turned manually in a clockwise direction thereby causing lever arm 12 and associated snuffer cap 11 to rotate from the position shown in FIG. 3 to the position shown in FIG. 2 such that snuffer cap 11 covers wick 10. This action reduces the supply of oxygen to wick 10 and extinguishes the flame.

Figure 4:
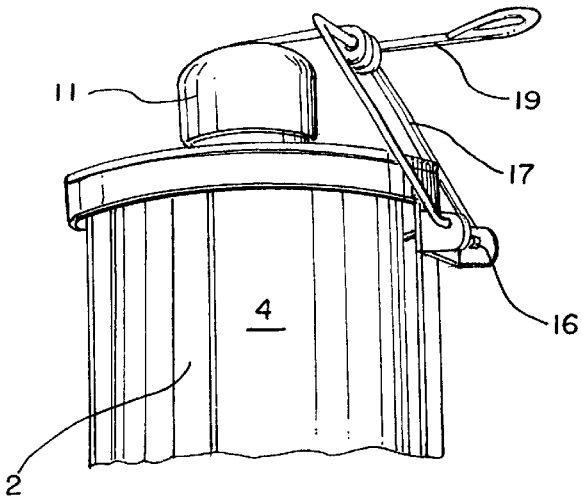
FIG. 4 is a perspective view of the upper portion of a modification of the torch.
Figure 5:
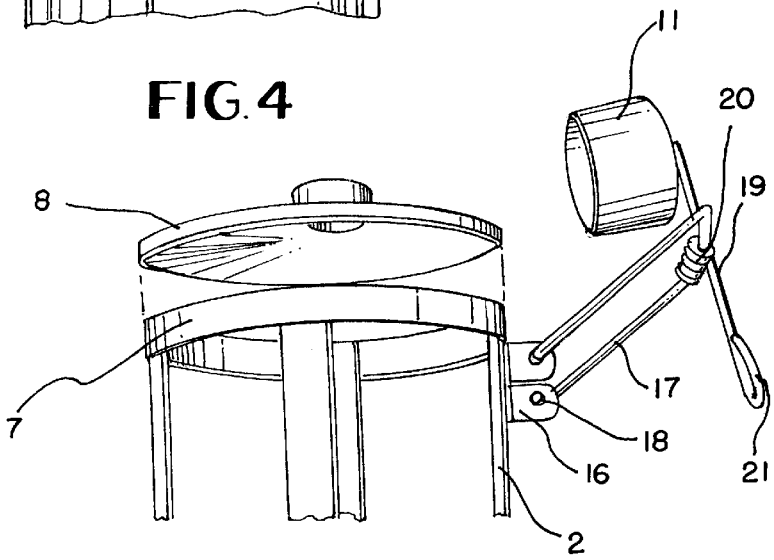
FIG. 5 is an exploded perspective view of the upper portion of the modified torch.
Figure 6:
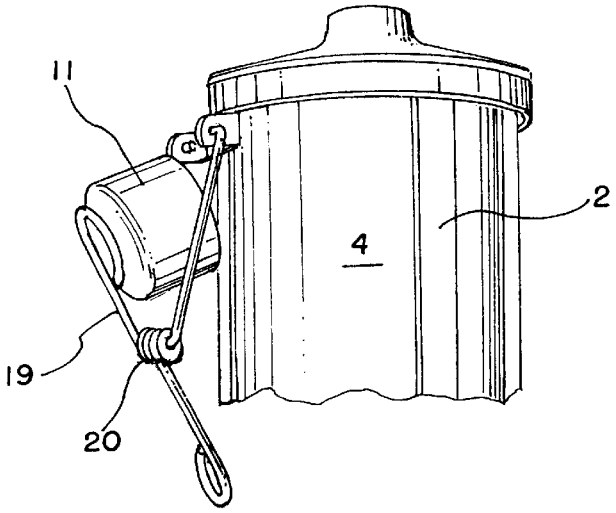
FIG. 6 is a perspective view similar to FIG. 4 with the snuffer cap in the open position.

A modified form of the invention is shown in FIGS. 4, 5 and 6 wherein the basic elements of the torch are the same as the version of the invention shown in FIGS. 1–3 and those identical elements are identified with the same numerals. The modification resides in the snuffer cap opening and closing mechanism wherein clamp 16 is affixed to one of the struts 2 by any suitable means such as welding and the like. U-shaped clip 17 is provided with inwardly projecting tabs 18 formed on the free ends thereof. Tabs 18 extend through corresponding apertures formed in clamp 16 thereby allowing clip 17 to rotate on clamp 16.

At the end of U-shaped clip 17 opposite from clamp 16, snuffer cap lever 19 is provided with integral helical element 20 formed generally at the midpoint thereof. U-shaped clamp 17 extends through helical element 20 as shown in FIGS. 4, 5 and 6. Snuffer cap 11 is secured to one end of snuffer cap lever 19 with manipulation loop 21 formed on the opposite end thereof. Of course, manual manipulation of loop 21 causes rotation of snuffer cap lever 19 with respect to U-shaped clip 17.

Therefore, by this modified form of the invention, when it is desired to expose the wick, snuffer cap 11 is removed from its position shown in FIG. 4 to its position shown in FIG. 6. In order to accomplish this result, manipulation loop 21, as shown in FIG. 4, is simply rotated downwardly thereby raising snuffer cap 11 away from wick 10. Simultaneously, snuffer cap lever 19 and associated snuffer cap 11 are rotated downwardly by means of U-shaped clip 17 rotating on bracket 16. This motion is continued until the assembly is maneuvered to the position shown in FIG. 6. Of course, when it is desired to extinguish the flame, the process is simply reversed wherein snuffer cap 11 is swung upwardly and into a position covering wick 10.

Therefore, by the modified form of the invention, wick 10 is easily and conveniently covered and uncovered as desired while at the same time keeping the opening and closing apparatus cool to the user's touch. Additionally, when the mechanism is disposed as shown in FIG. 6, it lies in close proximity to fuel container 4 and does not project outwardly of the torch as for instance in connection with the version of the invention shown in FIG. 3.

Therefore, by this invention, a torch is used essentially for entertainment purposes and allows the user to light the torch and then easily and conveniently extinguish the flame. Since the snuffer cap opening and closing mechanism is spaced from the flame, it is always cool to the touch thereby preventing any undesirable injury to the user.

What is claimed is:

1. A torch comprising a base, multiple struts upstanding therefrom and multiple rims disposed in abutting relationship with respect to said struts to form a frame, a fuel container disposed within said frame, a U-shaped clip rotatably attached to said frame to define a first pivot point at one end thereof, a lever rotatably attached to said U-shaped clip to define a second pivot point at the other end thereof, a snuffer cap attached to said lever at one end thereof, and said snuffer cap being rotatable about said first and second pivot points to a position in close proximity to said fuel container.

2. A torch according to claim 1 wherein a flame guard cap is attached to the upper edge of said frame and an aperture is formed in said flame guard cap.

3. A torch according to claim 2 wherein a wick is disposed in said aperture and said snuffer cap is adapted to cover said wick.

4. A torch according to claim 1 wherein said lever is attached to said U-shaped clip by means of a helical element.

5. A torch according to claim 4 wherein said U-shaped clip is rotatably attached to one of said struts and said U-shaped clip is attached to said strut by means of a bracket.

6. A torch according to claim 5 wherein said U-shaped clip is rotatably attached to said bracket.

7. A torch according to claim 4 wherein said helical element is disposed generally at the midpoint of said lever.

8. A torch according to claim 1 wherein struts comprise outer surfaces and wherein said rims are secured to said outer surfaces.

* * * * *